US005898174A

United States Patent [19]

Franzen

[11] Patent Number: 5,898,174

[45] Date of Patent: Apr. 27, 1999

[54] GEOMETRY FOR A LINEAR TIME-OF-LIGHT MASS SPECTROMETER WITH VERY HIGH RESOLUTION

[75] Inventor: Jochen Franzen, Bremen, Germany

[73] Assignee: Bruker Daltonik GmbH, Bremen, Germany

[21] Appl. No.: 08/925,629

[22] Filed: Sep. 9, 1997

[30] Foreign Application Priority Data

Sep. 11, 1996 [DE] Germany ..... 196 36 797

[51] Int. Cl.[6] ..... H01J 49/40

[52] U.S. Cl. ..... 250/287

[58] Field of Search ..... 250/287, 281

[56] References Cited

U.S. PATENT DOCUMENTS 5,504,326 4/1996 Reilly et al. ..... 250/282
5,510,613 4/1996 Reilly et al. ..... 250/287

FOREIGN PATENT DOCUMENTS 2308491 6/1997 United Kingdom .
2308492 6/1997 United Kingdom .
PCT/US 9607133 11/1996 WIPO .

OTHER PUBLICATIONS

Steven M. Colby et al., Anal. Chem. 1996, 68, *Space–Velocity Correlation Focusing,* pp. 1419–1428.

F. Chandezon et al., Rev. Sci. Instrum. 65(11), Nov. 1994, *A New–Regime Wiley–McLaren Time–Of–Flight Mass Spectrometer,* pp. 3344–3353.

P. Piseri et al., International Journal of Mass Spectrometry and Ion Processes 153 (1996), *Parameterization Of A Two–Stage Mass Spectrometer Performing Second–Order Space Focusing,* pp. 23–28.

J.M. Grundwurmer et al., Int. J. Mass Spectrom. Ion Processes 131 (1994), *High–Resolution Mass Spectrometry In A Linear Time–Of–Flight Mass Spectrometer,* pp. 139–148.

*Primary Examiner*—Kiet T. Nguyen

[57] ABSTRACT

A linear time-of-flight mass spectrometer which operates using ionization of analyte substances adsorbed on a sample support plate and an improvement in mass resolution through delayed acceleration of the ions in front of the sample support plate. The geometric design of the mass spectrometer consists of focusing the flight time of the ions in second or higher order by maintaining geometric requirements for the lengths of acceleration paths in the ion source relative to the field-free flight path length. In computer simulations, resolutions of flight time greater than one million have been obtained even for very high ion masses provided there is a correlation in space and velocity distribution when switching on the acceleration.

9 Claims, 5 Drawing Sheets

GEOMETRY FOR A LINEAR TIME-OF-LIGHT MASS SPECTROMETER WITH VERY HIGH RESOLUTION

FIELD OF INVENTION

The invention relates to a linear time-of-flight mass spectrometer which operates using ionisation of analyte substances adsorbed on a sample support plate and an improvement in mass resolution through delayed acceleration of the ions in front of the sample support plate. It especially relates to the geometric design of the mass spectrometer for very high mass resolution in the spectrum.

PRIOR ART

Second order focusing relative to varying initial velocities has not been explicitly known for a linear mass spectrometer with delayed acceleration. However, in the publication "Space-Velocity Correlation Focusing" by S. M. Colby and J. P. Reilly, Anal. Chem. 1996, 68, 1419–1428, deviation curves in flight times for varying initial velocities are represented which suggest a second order focusing, without the authors describing it as such. These curves were calculated by simulation programs, although their basis has not been represented in such detail that they can be verified without further explanations by the authors. The general basis for the simulations is a strict correlation of space and velocity distribution of the ions when switching on the acceleration such as has been customary for the MALDI process of ionization.

Since this article concerns an unusual, very short mass spectrometer with two other post-accelerating paths after the field-free flight path, it cannot not be excluded that the combination of four accelerating paths in total, one of which with delayed ion acceleration, causes this type of focusing. The voltages were not temporally altered after switching on the acceleration, with the exception of an experiment in switching on the acceleration with finite rise time, which however, as stated by the authors, causes no substantial change in focusing results. Statements regarding the reasons for good focusing or a systematic analysis of the geometric or electrical parameter ranges for good focusing are not included in the article.

For stationary, unswitched acceleration in two consecutive accelerating regions with subsequent field-free flight path, the occurrence of second order focusing only occurs under spatial distribution of the resulting ions is known. This second order focusing only occurs under geometrically restricted circumstances. In a recent patent application of the same inventors (BFA 45/96), second order focusing is described using an accelerating field which varies temporally after switching on, which can be applied to practically all known geometric designs of time-of-flight mass spectrometers.

Among the methods for ionization of macromolecular substances on sample supports, matrix assisted desorption by laser light flashes (MALDI=matrix assisted laser desorption and ionization) has found the widest acceptance. After leaving the surface, the ions generally have a substantial average velocity, which is to a large extent the same for ions of all masses, and a large spread around the average velocity. The average velocity leads to a non-linear relationship between the flight time and the root of the mass, i.e. the mass scale. The spread leads to a low mass resolution when measuring the signals of the individual ion masses; however a method has been known for some time for improving mass resolution. For normal linear time-of-flight mass spectrometers (including all those commercially available), a first order focusing thereby results.

However, similar conditions also apply for other methods of ionization of substances which are applied to a surface. Examples of this are secondary ion mass spectrometry (SIMS), normal laser desorption (LD) or so-called plasma desorption (PD), which is obtained by high-energy fission products on thin films.

For ionization by matrix-assisted laser desorption (MALDI), the large sample molecules are stored on a sample support in or on a layer of low-molecular matrix substance. A light pulse of a few nanoseconds duration from a laser, which is focused onto the sample surface, vaporizes a small amount of the matrix substance in a quasi-explosive process, whereby the sample molecules are also transferred into the initially tiny vapor cloud.

The vapor cloud expanding into the vacuum not only accelerates the molecules and ions of the matrix substance through its adiabatic expansion, but also the molecules and ions of the sample substance through viscous entrainment, which thereby receive higher kinetic energies than would correspond to the thermal equilibrium. Even without an accelerating field, the ions attain average velocities of about 500 to 700 meters per second, dependent upon the energy density of the laser beam; the velocities are to a large extent independent of the mass of the ions, however they have a large spread of velocities which range from about 200 up to 1,200 meters per second.

The ions are accelerated in the ion source with electrical fields at energies of around 5 to 30 keV, are shot into the flight path of the mass spectrometer and detected with high time resolution at the end of the flight path. From their flight time, their mass-to-charge ratio can be determined. To arrive at good measuring conditions and good mass resolutions, the flight path must be as long as possible; time-of-flight mass spectrometer with flight paths up to six meters in length are available commercially. Since-this type of ionization practically supplies only singly charged ions, the term "mass determination" will be used throughout the following discussion, not the more correct term "determination of the mass-to-charge ratio".

Flight times are converted into mass via a calibration curve which can be stored in table form as a sequence of value pairs, flight times and masses, in the memory of the data processing system, or also in the form of parameter values for a mathematical function of the mass relative to the time of flight. Due to the average initial velocity of the ions, the relationship between mass and square of the flight time is nonlinear, and the determination of mass from the flight time is therefore not trivial. All influences on the average initial velocity, such as laser energy, laser focusing or MALDI preparation, also change the relationship between flight time and mass.

For mass determination, the flight time $\tau$ must be determined exactly to within fractions of a nanosecond. Since the mass signal is available as a line profile of ion current versus flight time, the centroid of this line profile is normally used for exact determination of the flight time. The line profile is scanned according to current technology using a transient recorder with 1 or 2 gigahertz. Transient recorders with 4 and 10 gigahertz scanning rates are being developed.

Generally, the measurements from several measuring cycles are cumulated before the centroid is created.

During formation of the vapor cloud, a small part of the molecules, and these are both matrix and sample molecules, are ionized. But during explosive expansion of the vapor cloud, continuous ionization of the large molecules takes place through further ion-molecule reactions at the cost of the smaller matrix ions. The large spread of velocities and the time-smeared formation process of the ions limit the mass resolution both of linear as well as energy-focusing, reflecting time-of-flight mass spectrometers, if no special measures are taken.

A method for improvement of mass resolution under these conditions has been known for some time. This method is based upon the fact that for all desorption methods there is a correlation between the space and velocity distribution if the ions were allowed to spread out in a field-free space.

The ions of the cloud are therefore first allowed to fly a brief time $\tau$ in a drift region without any electrical acceleration. The faster ions thereby distance themselves further from the sample support electrode than the slow ions, and the distribution of the ion velocities results in a spatial distribution. Only then is the acceleration of the ions switched on. The acceleration takes place in a temporally constant, homogeneous accelerating field, i.e. with a spatially and linearly declining accelerating potential. The faster ions are then further away from the sample support electrode, and therefore at a somewhat reduced accelerating potential, which gives them a somewhat lower final velocity for the drift region of the time-of-flight spectrometer than the initially slower ions. With correct selection of the time lag $\tau$ and potential drop (i.e. the strength of the acceleration field), the initially slower, but after acceleration faster ions catch up again with the initially faster, but after acceleration slower ions exactly at the detector. In this way, ions are dispersed at the location of the detector relative to the mass, but if of equal mass, are focused again relative to the flight time. In this way, a relatively high mass resolution is achieved even in a linear time-of-flight mass spectrometer. There is an analogous method for time-of-flight spectrometers with reflectors.

Delayed ion acceleration must not mean to switch the entire accelerating voltage U. It is not only that switching of such high voltages in extremely short times of a few nanoseconds is still almost unattainable today and associated with high costs but introduction of an intermediate diaphragm also leads to better focusings.

Switching of a partial accelerating voltage $U_1$, is sufficient by installing an intermediate electrode in the acceleration path. Then only the space between the sample support electrode and the intermediate electrode, which are a relatively small distance $d_1$ from one another, need be field-free at first and then switched over after a delay into an acceleration field with a strength of $U_1/d_1$. The distance $d_1$ of the sample support to the intermediate electrode should be as small as possible in order to switch the lowest possible voltages $U_1$. There is a lower limit of about two millimeters for this distance, which is hardly realizable however for practical designs of ion sources. In practice, this distance d, is about three millimeters.

An ion source for delayed initiation of acceleration therefore generally has at least one intermediate diaphragm between the sample support and the base electrode, which is at the potential of the field-free flight path. The ion source is therefore operated with at least two accelerating voltages, of which the first is applied between the sample support and the first intermediate electrode and the last between the last intermediate electrode and the base electrode. Normally, only one intermediate electrode is used, in which case there are then two accelerating voltages.

The method of delayed ion acceleration does however also have its disadvantages. It provides the optimum mass resolution only in a narrow range of the mass scale. In the other parts of the total spectrum, the resolution is still considerably improved but not up to its optimum limit value. This range of optimum resolution may be adjusted to any desired position on the mass range by changing the time lag $\tau$ or by changing the partial accelerating voltage $U_1$, so that this disadvantage does not have too great an influence.

This does not apply to another, extremely decisive disadvantage for exact mass determination in the higher mass range: optimum mass resolution quickly decreases the higher the mass. For reasons of first order initial ion velocity focusing, the mass resolution is dependent on the velocity spread of the ions in front of the sample support. For a velocity distribution between 0 and 1,200 meters per second, mass resolution during first order focusing is limited theoretically to maximum values of about $R_m$=40,000,000 amu/m, according to a rule of thumb derived from computer simulations. This rule is essentially independent from the length of the flight path, i.e. of the size of the mass spectrometer.

Here, departing from the standard definition, mass resolution is understood to be the flight time of ions divided by the complete line width at the foot of the line (measured in the same time units), and not by the usual width at half height. For ions of the mass m=1,000 amu, a resolution of about $R_m$=40,000 is thereby obtained which however drops for ions of the mass m=8,000 amu to $R_m$=5,000. This means that two ions of the masses $m_1$=8,000 amu and $m_2$=8,001 amu can no longer be separated from one another. Therefore, for higher masses, the known isotope patterns of organic ions certainly cannot be resolved. In practice, these values even appear somewhat worse.

The poor mass resolution for ions of a higher mass also leads to a poorer signal-to-noise ratio, and therefore to poorer sensitivity and to poorer detection capability.

OBJECTIVE OF THE INVENTION

It is the objective of the invention to considerably improve the achievable mass resolution of simply designed, linear time-of-flight mass spectrometers, especially in the higher mass range.

BRIEF DESCRIPTION OF THE INVENTION

The invention is based on the discovery that—even using delayed acceleration of ions—second order focusing is essentially only then possible if the sum of the lengths of the accelerating paths in the ion source is essentially larger than one eighth of the field-free flight path $d_3$. The achievable resolution increases with the length of the acceleration paths; however, if the sum of the accelerating path lengths becomes greater than half the field-free flight path $d_3$, there will no longer be any second order focusing. In addition, the first acceleration path should amount to ⅓ of the total acceleration path length in maximum. No time-of-flight spectrometer known today satisfies these requirements. Optimum focusing will be achieved if the sum of acceleration lengths is in the range between $d_3/4$ and $d_3/2$ and the first acceleration path is less than 1/10 of the total acceleration path length..

It is, therefore, the basic claim of the invention to construct a time-of-flight mass spectrometer in such a way that these requirements are satisfied.

If two acceleration regions of lengths $d_1$ and $d_2$ are used, the analysis has shown that the resolution is better if the first accelerating path length $d_1$ is rather small relative to the second accelerating path length $d_2$. Then there even exists an optimum with third order focusing which is, however, mass dependent.

It is therefore a further claim of the invention to design the mass spectrometer in such a way that the first accelerating path $d_1$ is smaller than one tenth of accelerating path $d_2$. The optimum is somewhere in the range of $d_2/60<d_1<d_2/20$.

For certain ratios of the lengths $d_1$, $d_2$ and $d_3$, third order focusing points result for one mass. The resulting high time-of-flight resolution (and therefore also high mass resolution) can be adjusted to any mass of the mass range by slight variations in those geometrical ratios. Here it arises that, below this mass for which a third order focusing was geometrically adjusted, also the second order focus points, adjustable purely through electrical changes, display unusually high resolutions.

It is therefore a further claim of the invention to select the geometric ratios in such a way that a third order focusing is achieved for the upper limit of the mass range of interest.

Figure 1:
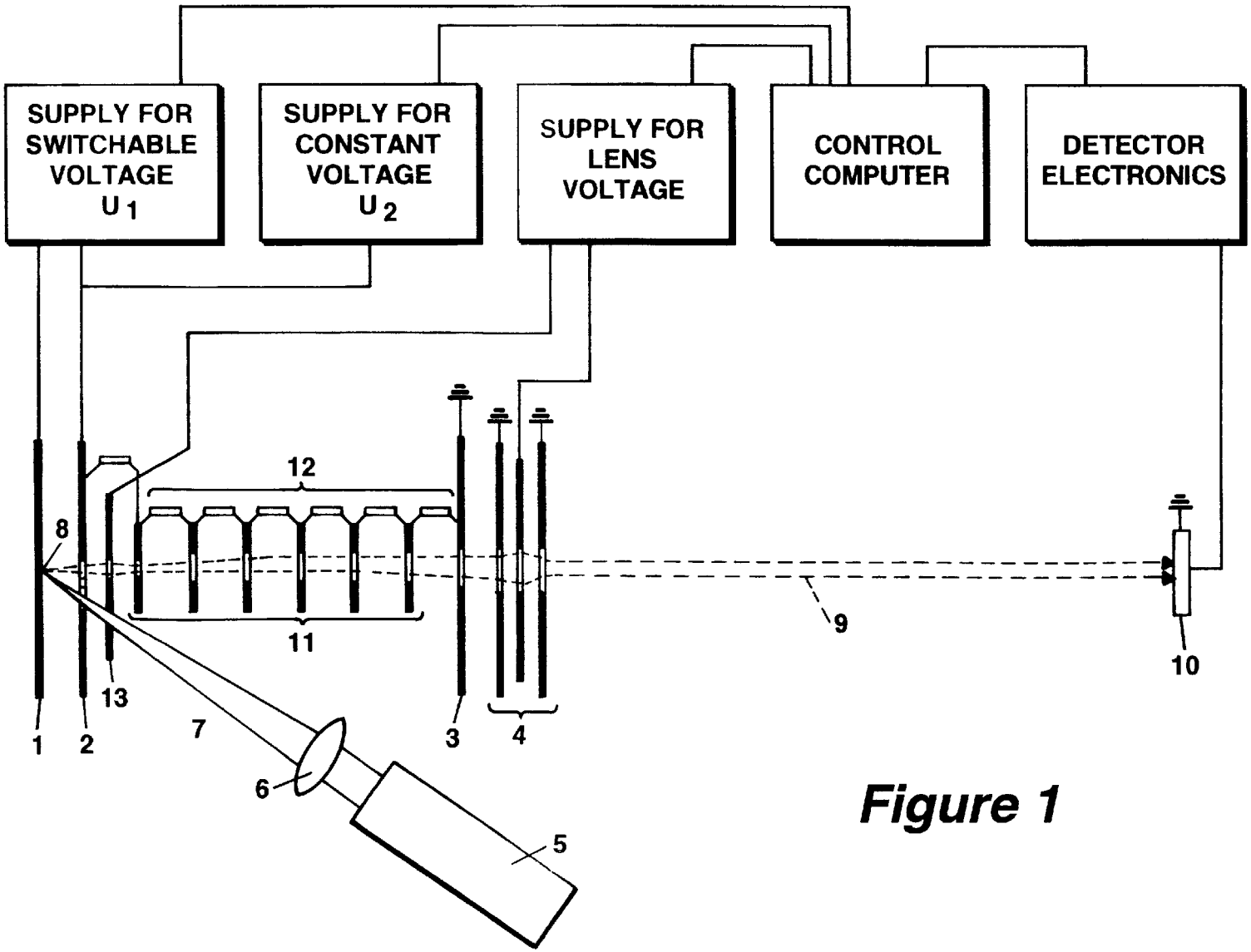
FIG. 1 shows the principle design of a time-of-flight mass spectrometer with its schematically indicated supply units. Its sample support electrode 1 is at the accelerating potential $U=U_1+U_2$, the intermediate electrode 2 is at the potential $U_2$, the base electrode is at ground potential. In the second accelerating path, a first ion-optical lens 13 is integrated, in the fieldfree flight path between base electrode and detector 10, there is a second lens 4, which is designed as an ion beam Einzel lens, and both external diaphragms are at the potential of the flight path. The second accelerating path is equipped with homogenization diaphragms 11 for the field; via the resistors 12 of the voltage divider, these diaphragms are provided with the appropriate potentials.

The acceleration regions are defined as follows:

First accelerating region $d_1$ between sample support electrode 1 and intermediate electrode 2;

Second accelerating region $d_2$ between intermediate electrode 2 and base electrode 3; field-free flight path $d_3$ between base electrode 3 and detector 10.

The accelerating voltage $U_1$ between sample support 1 and intermediate diaphragm 2 is switchable. A light flash from laser S is focused by lens 6 into a convergent light beam 7 onto sample 8, which is on sample support 1. At this time, the accelerating voltage voltage has the value $U_1=0$. The light flash generates ions from the analysis substance in a MALDI process with an average initial velocity $v\approx600$ meters per second and a large velocity spread. After a time lag $\tau$, the accelerating voltage $U_1$, is switched on; as of this time $t=\tau$, the ions are accelerated. They form beam 9 of the ion current which is measured by time resolution by detector 10 after passing through the field-free flight path between base electrode 3 and detector 10.

The arrangement shown here has gridless diaphragms for intermediate electrode 2 and base electrode 3 and therefore needs lenses 13 and 4 to make ion beam 9 parallel. Lens 13 focuses the ion beam, which diverges due to its lateral velocity components, and the lens is also needed for the embodiment of the intermediate diaphragm with a grid. In FIG. 1, only a partial focusing is generated through lens 13. Einzel lens 4 focuses the divergence which is generated by the effect of the gridless base electrode 3; when a grid is introduced into base electrode 3, Einzel lens 4 is no longer necessary. On the other hand, the intermediate grids reduce the achievable resolution due to their unavoidable small-angle scattering.

Figure 2:
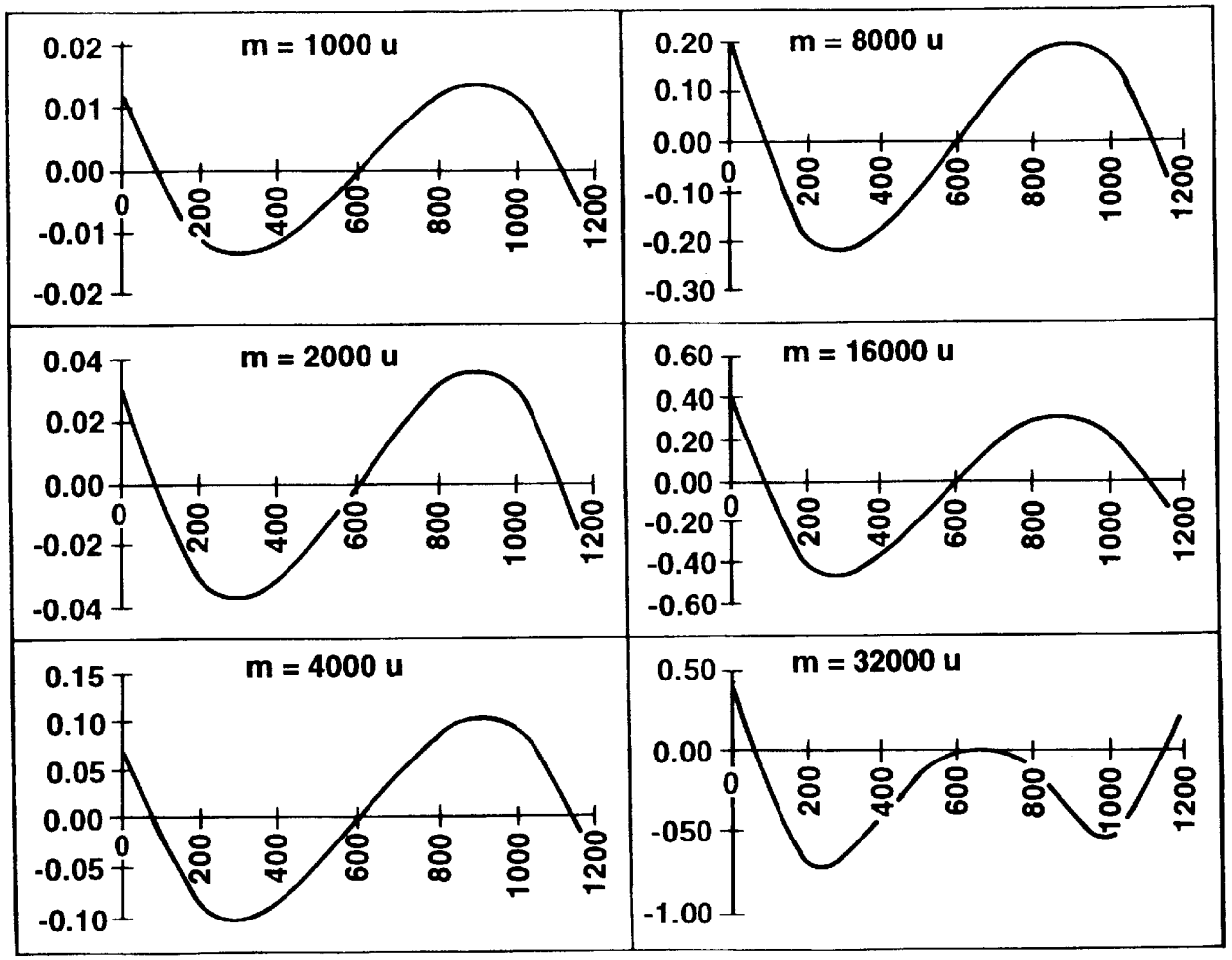

FIG. 2 shows a diagram of flight time deviations (in ppm of flight time, vertical axis) applied to the initial velocity (in meters per second, horizontal axis) for an optimum adjustment with which ions in the mass range of up to 32,000 amu are intended to be measured. At the mass of 32,000 amu, third order focusing is set by adjusting distance $d_1$, discernible on the fourth order curve. The second accelerating voltage is fixed at 27 kilovolts. The distances $d_1:d_2:d_3$ behave like 9:200:550. The corresponding time resolutions and electrical settings are as follows:

TABLE 1 (belongs to Figure 2)

Third order focus point at a mass of 32,000 amu

| Mass [amu] | Time resolution | $\tau$ [ns] | $U_1$ [kV] |
|---|---|---|---|
| 1,000 | 43,431,835 | 880.3 | 2.242 |
| 2,000 | 16,286,148 | 1246.4 | 2.241 |
| 4,000 | 5,638,800 | 1765.5 | 2.239 |
| 8,000 | 2,624,560 | 2500.9 | 2.238 |
| 16,000 | 1,227,891 | 3542.1 | 2.236 |
| 32,000 | 914,569 | 5011.0 | 2.236 |

Figure 3:
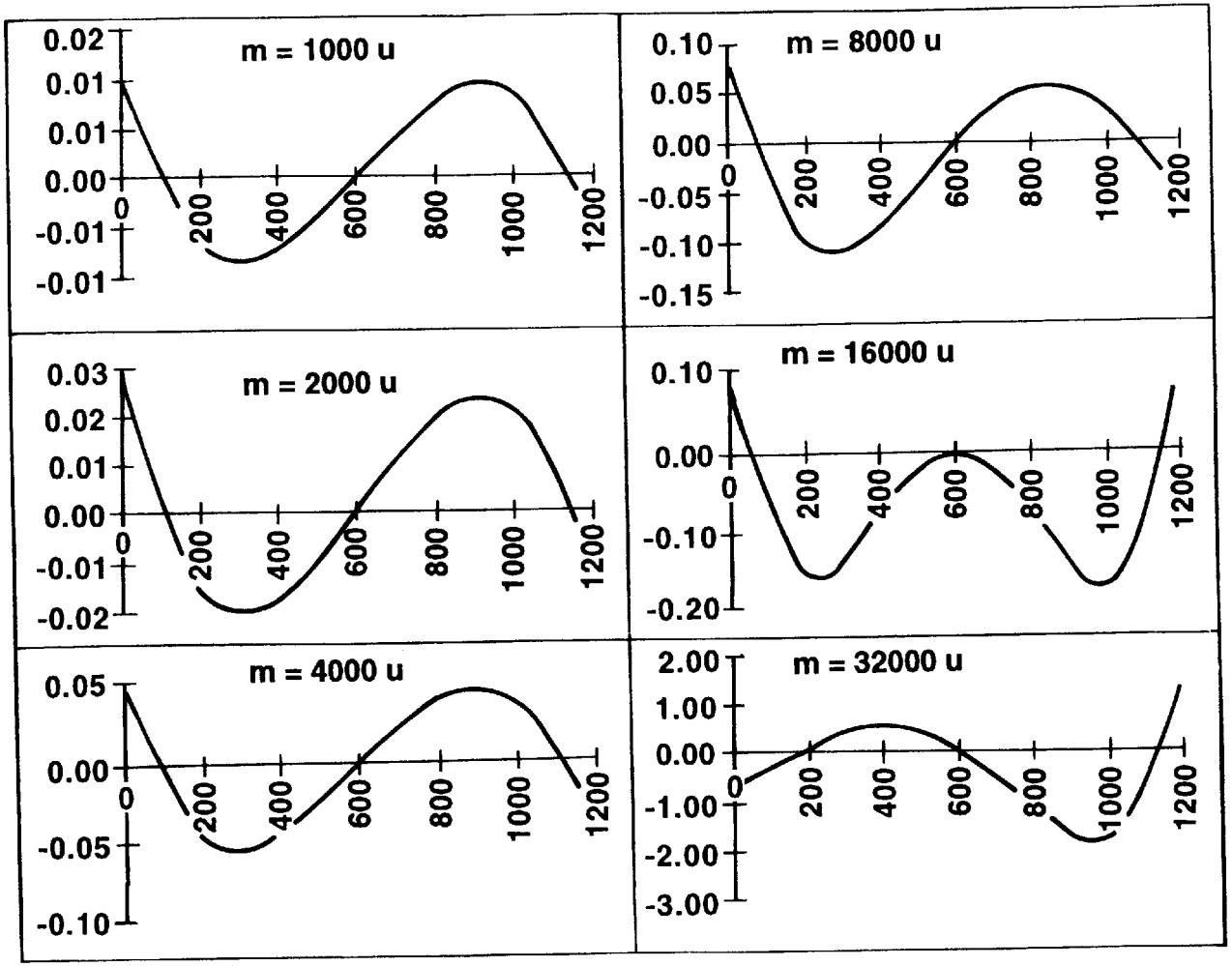

FIG. 3 shows a diagram of flight time deviations in case the mass is only to be measured to 16,000 amu. Therefore the third order focus point is set to the mass 16,000 amu by adjusting distance $d_1$. The distances $d_1$: $d_2$ : $d_3$ are only slightly different from those in FIG. 1, they behave like 8:200: 550. The corresponding time resolutions and electrical settings are as follows:

TABLE 2 (belongs to Figure 3)

Third order focus points at a mass of 16,000 amu

| Mass [amu] | Time resolution | $\tau$ [ns] | $U_1$ [kV] |
|---|---|---|---|
| 1,000 | 57,756,717 | 836.1 | 1.989 |
| 2,000 | 21,301,169 | 1183.4 | 1.988 |
| 4,000 | 10,730,964 | 1674.7 | 1.988 |
| 8,000 | 5,278,135 | 2370.0 | 1.987 |
| 16,000 | 4,027,401 | 3351.9 | 1.987 |
| 32,000 | 326,126 | 4733.1 | 1.988 |

Beyond the optimal mass 16,000 u, the optimum adjustable time resolution quickly declines, although it is still very high.

Figure 4:
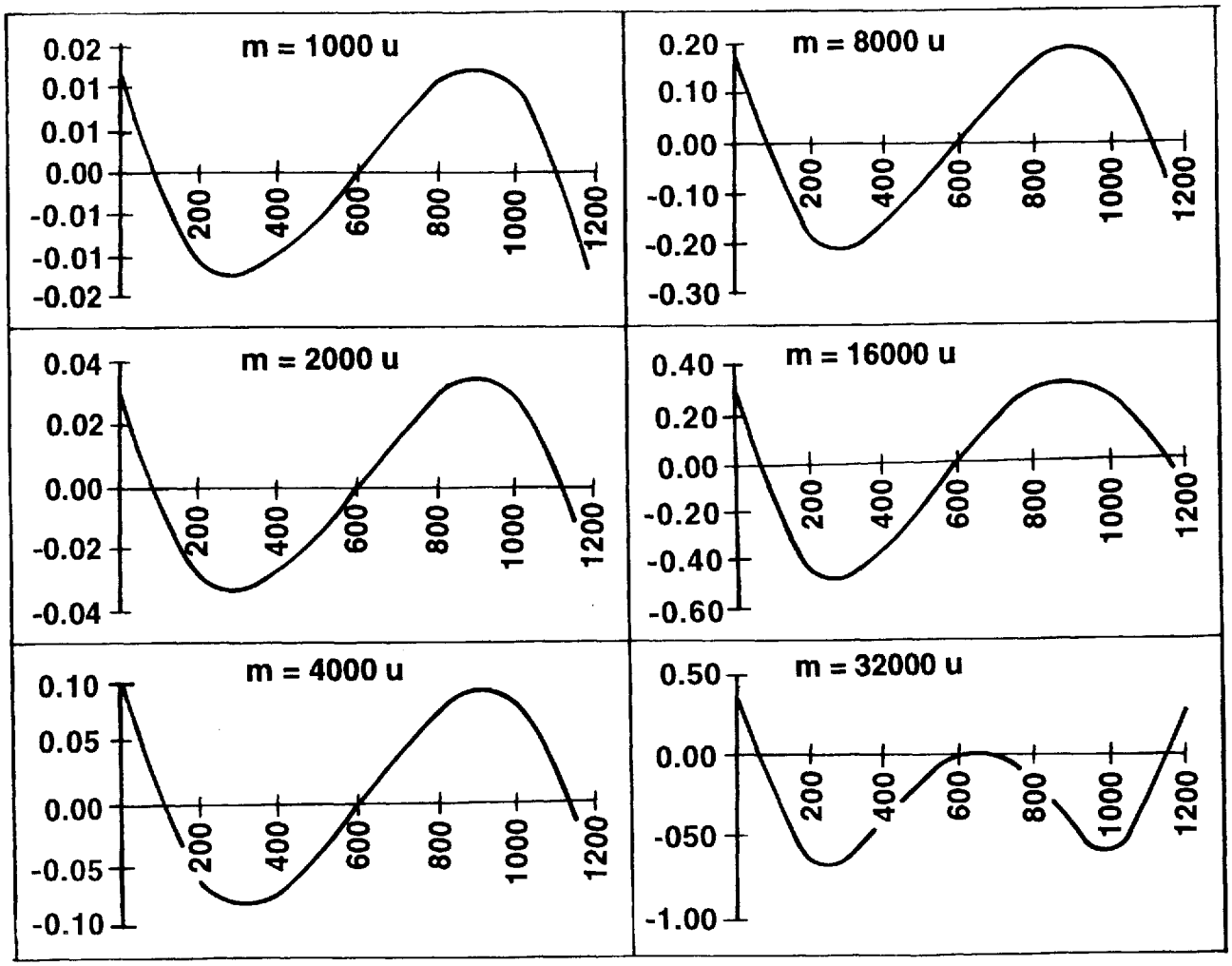

FIG. 4 shows a diagram of flight time deviations in case of a very short distance $d_1$. The distances $d_1$: $d_2$: $d_3$ behave like 5:244:550. The second accelerating voltage is again fixed at 27 kilovolts. The corresponding time resolutions and electrical settings are as follows:

TABLE 3 (belongs to Figure 4)

Time resolutions at a minimal short distance $d_1$

| Mass [amu] | Time resolution | $\tau$ [ns] | $U_1$ [kV] |
|---|---|---|---|
| 1,000 | 40,513,601 | 690.8 | 1.088 |
| 2,000 | 15,971,218 | 977.8 | 1.088 |
| 4,000 | 5,860,431 | 1384.1 | 1.087 |
| 8,000 | 2,745,832 | 1959.2 | 1.087 |
| 16,000 | 1,342,689 | 2773.0 | 1.086 |
| 32,000 | 1,005,720 | 3922.1 | 1.086 |

Figure 5:
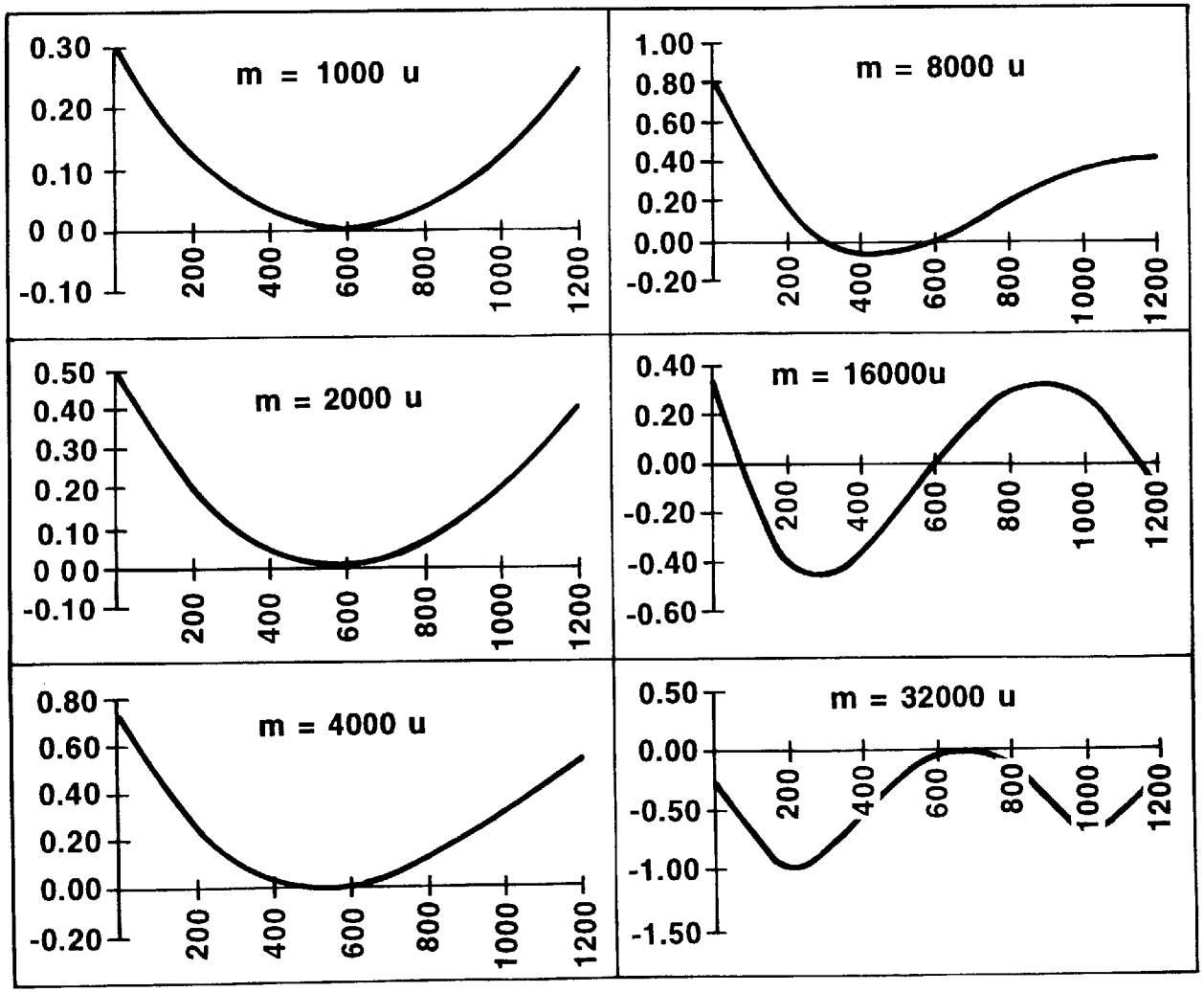

FIG. 5 shows the flight time deviations during adjustments which were made only through the time lag $\tau$. The first accelerating voltage was set exactly to 1,086 Volts. All settings are otherwise as in FIG. 4. These settings no longer lead to second order focusing everywhere, however the resolutions are more than sufficient. For all masses, time resolutions of greater than one million and mass resolutions of greater than 500,000 have been achieved. In this case the mass is very precisely proportional to the square of the flight time, and in this way the calibration of the mass scale is very simple:

| Mass [amu] | Time resolution | $\tau$ [ns] | $U_1$ [kV] |
|---|---|---|---|
| 1,000 | 3,380,057 | 693.4 | 1.086 |
| 2,000 | 2,015,882 | 980.5 | 1.086 |
| 4,000 | 1,367,881 | 1386.5 | 1.086 |
| 8,000 | 1,103,916 | 1960.7 | 1.086 |
| 16,000 | 1,342,689 | 2773.0 | 1.086 |
| 32,000 | 1,003,463 | 3921.7 | 1.086 |

DETAILED DESCRIPTION OF THE INVENTION

Systematic analysis of the focusing conditions produced by delayed ion acceleration has shown that second or even third order focusing can exist when certain geometric requirements are fulfilled. These geometric requirements are highly unusual for modem time-of-flight mass spectrometers. The requirements are very difficult to derive by analytical mathematics, therefore it is simpler to examine them using computer simulation programs.

A very simple time-flight mass spectrometer with two homogenous accelerating regions in the ion source and a subsequent field-free flight path was analyzed. In principle, almost all commercial mass spectrometers have this simple configuration even if they are not designed within the geometric parameter range required for higher order focusing. Additional post-accelerations after the field-free flight path did not show any effect upon resolution and focusing.

We will use the following definition to characterize the order of a focus. It is first order when the deviations of flight times of ions of different initial velocities, applied over the initial velocity, produce a parabola, the summit of which represents the average velocity. It is second order if this curve is a third order curve, the turning point of which represents the average velocity. It is third order if the deviation form a parabola of fourth order. This definition results from the definition of focus orders as zero points of the corresponding derivatives.

It was first determined in the analyses that second order focusing is essentially only then possible if the sum of the two accelerating paths $d_1+d_2$ is larger than one eighth of the field-free flight path $d_3$. In addition, $d_1$ should be smaller than $d_2/2$. No time-of-flight spectrometer known today satisfies this requirement.

Under unfavorable conditions for the ratio $d_1/d_2$, there are some slight exceptions from the rule presented here. One of these exceptions is the focusing condition in the above quoted article. The resolution in these exceptions is not very favorable.

If the accelerating path length is greater than half the field-free flight path $d_3$, there will no longer be any second order focusing. Optimum focusing is achieved only in the range $d_3/4 \leqq (d_1+d_2) \leqq d_3/2$.

It is the basic claim of the invention to construct a time-of-flight mass spectrometer in such a way that these requirements are satisfied.

This means however that the accelerating path will be very long in general. Its field must therefore (as is already normally done for reflectors) be supported by homogenization diaphragms. The homogenization diaphragms are supplied with voltages via a voltage divider in such a way that a constant field is obtained in the interior.

The analyses have also shown that the resolutions provided by the focusings are better if the first accelerating path $d_1$ is small in relationship to the second accelerating path $d_2$. There even exists—with relatively small lengths $d_1$ for the accelerating path—an optimum with third order focusing which is, however, mass dependent.

It is therefore a further claim of the invention to construct the mass spectrometer in such a way that the first accelerating path $d_1$ is somewhere in the range of $d_2/60 < d_1 < d_2/20$.

For certain ratios of the lengths $d_1$, $d_2$ and $d_3$, third order focusing points result for one mass. These sharpest mass signals of very high time-of-flight resolution (and therefore also high mass resolution) can be adjusted to any mass of the mass range by slight variations in those geometrical ratios. Here it arises that below this mass for which a third order focusing was geometrically adjusted, also the second order focus points, adjustable purely through electrical changes, display unusually high resolutions.

It is therefore a further claim of the invention to select the geometric ratios in such a way that a third order focusing is achieved for the upper limit of the mass range of interest If, for example, the mass range of interest extends to 32,000 amu, one can then push the third order focus point onto the mass 32,000 amu with the ratio $d_1:d_2:d_3=9:200:550$ (first example), and there one obtains—at about 30 kilovolts total accelerating voltage—a theoretical flight time resolution of about $R_t=900{,}000$. This ratio is however not the only one which will give an optimal resolution at a mass of 32,000 amu. With the ratio $d_1:d_2:d_3=5:244:550$ (second example) one can even reach a time-of-flight resolution of a million at the mass 32,000 amu. The resolutions are completely independent from the absolute size of the spectrometer in this theoretical case of a strictly valid correlation between spatial distribution and velocity distribution; only the geometric ratios are important.

If one fixes these geometric ratios in a mass spectrometric apparatus, high resolutions can be achieved for all masses beneath this limit mass through pure electrical adjustments by second order focusing. The electrical settings refer here to the time lag $\tau$ and the first accelerating voltage $U_1$.

If the mass range of interest only extends to 16,000 amu, one can adjust the third order focus point to this mass with only slightly changed ratios $d_1:d_2:d_3=8:200:550$ (for the first example) or $d_1:d_2:d_3=4.45:244:550$ (for the second example) and obtain electrically adjustable time resolutions above four million in the entire mass range of interest.

The short first accelerating path $d_1$, according to the ratios provided by the second example, is very favorable:

First, the field does not need to be homogenized using additional diaphragms. This primarily benefits the switching of the accelerating voltage, which needs a low electrical capacity for a rapid switching procedure.

Second, the accelerating voltage to be switched is reduced in this way. This is proportional to the path $d_1$.

Third, the time lag $\tau$ however also becomes proportionally reduced. This causes the axial and especially the lateral expansion of the vapor and ion cloud to be smaller and the spatial focusing of the laterally escaping ions is more successful.

It is therefore very important to make the first accelerating path as short as at all possible. However, there is also a lower limit for the accelerating path $d_1$. If it is too small (such as with $d_1:d_2:d_3=4.3:250:550$), the expanding ion cloud collides against the intermediate diaphragm within the optimum set time lag for heavy ion masses. This case can therefore practically not be used. It is therefore a further claim of this invention to construct a mass spectrometer with the optimum ratios $d_1:d_2:d_3=5$ (±20%) :244 (±10%):550.

Two adjustment parameters suffice for the electrical adjustment of the optimum second or third focus points via the mass range. It has proven favorable to only change the time lag $\tau$ and the first accelerating voltage $U_1$. In this case the accelerating voltage $U_1$ need only to be changed by about 0.3%. If this accelerating voltage $U_1$ is kept at the optimal value for a mass of 32,000 amu, and only the time lag $\tau$ is changed, no second order focusings will then occur over the entire mass range anymore, but there will still be resolutions which exceed those at a mass of 32,000 amu. Therefore an operation is possible in which only one single adjustment parameter is required for the shifting of the point of optimum focus (optimum resolution).

This manner of operation has the additional advantage that not only the once calibrated mass relationship remains undisturbed by the adjustment, but also that the flight time in this particular case is in practice strictly proportional to the root from the mass. Deviations from the proportionality are below one millionth of the flight time. In this way, calibrations of the relationship of mass to flight time become extraordinarily simple. It is therefore a further claim of this invention to shift the range of optimum focus only via the time lag and keep the accelerating voltages (with the exception of switching on) constant.

The great length of the accelerating paths for the ions also has disadvantages however. Since the ions obtain considerable lateral velocities in the explosively expanding vapor cloud, the ion beam diverges within the accelerating path. It is therefore a further claim of this invention to integrate an ion-optical lens for the ions in the second accelerating paths. This lens focuses the ion beam onto the detector, or makes the ion beam parallel This lens is already necessary if the intermediate diaphragm is designed as a grid; for a gridless design, further defocusing occurs at the entrance to the second acceleration path, so a lens is especially necessary here. Since another other defocusing occurs at the entrance to the field-free flight path, a second lens is favorable here. This may be designed as an Einzel lens.

The embodiments described here for the mass spectrometer were all described with only one intermediate diaphragm. This embodiment is especially simple and already leads to sufficient resolutions. Even higher resolutions can be achieved with the introduction of further intermediate diaphragms at appropriate potentials. In particular, a mass spectrometer can be built in this way which generates precise second order focusings only by adjusting of the time lag $\tau$. It is therefore a further claim of this invention to use more than just one intermediate electrode.

Particularly Favorable Embodiments

A design for a linear time-of-flight mass spectrometer with high resolution according to this invention is shown in principle in FIG. 1. Sample support 1 and intermediate electrode 2 have a relatively small distance $d_1$ to one another; the switchable field needs no homogenization electrodes. The long distance $d_2$ between intermediate electrode 2 and base electrode 3, on the other hand, requires homogenization of the field, implemented by the homogenization electrodes 11. These are supplied with voltage in the usual manner via the voltage divider with resistors 12.

Without an early focusing of the ion beam, the long accelerating path would lead to considerable beam widening since the ions in the exploding substance cloud also obtain accelerations in the lateral direction. The initial velocities are vectors which are directed away from the origin of the cloud. It is therefore favorable to focus the ion beam, which is divergent in spite of axial acceleration, as early as possible. This focusing is generated through lens 13 which is integrated grated into the second accelerating path. The lens eliminates divergences which are generated by the feed through of the field of the second accelerating path into the field-free flight path.

As designed above, the most favorable geometric embodiment is at a ratio of accelerating and flight paths of about $d_1:d_2:d_3=5:244:550$.

When using the above mentioned delayed ion acceleration, sample support 1 and intermediate electrode 2 are first at potential $U_2$. The sample support is switched up to the potential $U_1+U_2$ after the time lag $\tau$ of several hundred to thousand nanoseconds after the ionizing laser flash.

With the correct selection of time lag $\tau$ and the voltages $U_1$, and $U_2$, one achieves a high resolution at one mass in the spectrum by second order focusing, and for one mass, even third order focusing can be attained. Here, one of three adjustment parameters can be permanently selected, and for adjustment of the very high resolution, two adjustment parameters suffice.

When operating with $\tau$ and $U_1$, the accelerating voltage $U_1$ changes only minimally, so one therefore does better with variation of the time lag $\tau$ alone. Nevertheless this operation, which still does not bring about the practically unobtainable, very high resolutions, has enormous advantages since the function of mass versus flight time becomes very simple: the mass is practically proportional to the square of the flight time (for the ions of zero initial velocity, this condition is strictly fulfilled; for the ions of average initial velocity, there are minor deviations below a millionth of the mass).

With this arrangement for a time-of-flight mass spectrometer, spectra of analysis substances can be scanned as usual. Scanning begins with ionization of the sample substances 8 on the sample support 1, as in the MALDI method of ionization described here. The ions are generated by a light flash of about 3 to 5 nanoseconds duration from laser 5. Usually, UV light with a wavelength of 337 nanometers is used from a moderately priced nitrogen laser. The light flash is focused through lens 6 as convergent light beam 7 onto the sample 8 on the surface of the sample support 1. The ions formed in the vapor cloud, which is generated by the laser focus, are accelerated after the time lag $\tau$, first in the electrical field of strength $U_1/d_1$ between sample support 1 and intermediate electrode 2, and then in the electrical field of strength $U_2/d_2$ between intermediate electrode 2 and base electrode 3. The second accelerating field is only about half as strong as the first. The slightly defocused ion beam in the gridless electrode arrangement is focused at the beginning of the second accelerating path through lens 13 and at the beginning of the flight path in Einzel lens 4 onto detector 10. The flying ions form a temporally, strongly variable ion stream 9, which is measured at the end of the flight path by ion detector with high temporal resolution.

Through the special MALDI process, mass signals can be generated at the detector which have a temporal width of far less than one nanosecond, even though the light flash of the laser has a temporal length of 3 to 5 nanoseconds. (There is a "virtual", very sharply defined starting time for the adiabatic expansion).

The time-variable, ion current provided by the ion beam is usually measured and digitalized at the detector with a scanning rate of 1 or 2 gigahertz. Transient recorders with a much higher temporal resolution will soon be available. Usually, the concurrent measured values from several scans are cumulated before the mass lines in the stored data are sought and transformed by means of peak recognition from the time scale into mass values via the mass calibration curve.

The polarity of the high voltage used for the ion acceleration must be the same as the polarity of the ions being analyzed: positive ions are repelled and accelerated by a positively charged sample support, negative ions by a negatively charged sample support.

Of course, the time-of-flight mass spectrometer can also be operated in such a way that the flight path is in a tube (not shown in FIG. 1), which is at accelerating potential $U_1+U_2$ while the sample support 1 is at ground potential. In this special case, the flight tube is at a positive potential if negatively charged ions are to be analyzed, and vice versa. This operation simplifies the design of the ion source, since the isolators for the holder of the exchangeable sample support port 1 are no longer necessary. In this case it is favorable to switch and vary the potential of the intermediate electrode.

The focus range can be shifted as desired by control of two adjustment parameters, for example by the time lag $\tau$ and the initial accelerating voltage $U_1$. It is possible to perform the shift in such a way that the calculated mass scale remains valid. To do this, the accelerating voltage $U_2$ must also be very slightly changed in the appropriate manner. If this type of displacement of the focus range is permanently installed in the computer control of the mass spectrometer and no other control of the adjustment is permitted, this displacement of the focus range will not harm any mass determination, since the mass scale remains valid under these conditions.

However, it is more favorable and simpler to use the above described method of focus adjustment just using the time lag, since the mass determination from the flight time then becomes especially simple. The linear connection between mass and flight time square leads to a one-point calibration if initiation point $\tau$ of the acceleration is sufficiently well known. However, since a finitely expanded voltage rise is present in practice, which slightly shifts the factual initiation of the acceleration compared to the initiation of the control system, a two-point calibration is used in practice.

If the mass spectrometer is used for purposes during which the mass range of interest may shift extremely, one can make the distance $d_1$ of the sample support-from the intermediate diaphragm variably adjustable, if possible even from outside the vacuum system. In this way, conformity to extreme conditions is possible.

The invention is less well suited for mass spectrometers which are intended to measure fragment ions through MALDI-induced metastable decomposition (PSD=post source decay). The long accelerating path is unfavorable for this task.

However the invention presented here is the best basis for a mass spectrometer which should allow routine molecular weight determinations on large numbers of samples. Its use is particularly suitable for production controls on polymers or genetically engineered pharmaceuticals, for genotyping, for DNA-mutation screening or for genetic fingerprints of different objectives. All these tasks share the fact that the expected molecular weights are known; the mass spectrometer can therefore be adjusted for every sample in such a way that the range of best focus and highest mass resolution is at the spectrum location of expected molecular weight. In this way not only the greatest mass resolution is provided in this range, but also an especially good ratio of signal to background noise through narrow mass signal profiles, and therefore an especially low detection limit The fast and simple calculation of the mass from the flight time is favorable for high sample throughput. Although high resolution may not be achieved in practical operation, the independence of the flight time achieved by this, and therefore the independence of the mass determination from the average velocity of the ions, is extremely valuable, which the ions could receive during alternating conditions for the MALDI process. Changes in laser energy or focusing conditions of lasers, variations in the preparation of the MALDI lasers with influences on the average velocity of the ions are no longer of any importance.

The present tasks can be particularly well mastered if the molecule ions of interest are measured separately from neutral particles and fragment ions at the end of the field-free flight path, such as described in patent application BFA 46/96.

In describing this invention, the MALDI method for ionization of substances on the sample support was assumed. However, similar conditions also apply for other methods of ionization of substances which are applied to a surface. Examples of this are secondary ion mass spectrometry (SIMS), normal laser desorption (LD) or so-called plasma desorption (PD), which is obtained by high-energy fission products on thin films. Although the focus has been on the MALDI method, the invention is not limited solely to this method, but relates to all methods by which ions are generated which have a spread of initial velocities, even if it is generally not as large as for the MALDI process.

I claim:

1. Linear time-of-flight mass spectrometer for high-resolution measurements of analyte spectra, comprising (a) a sample support electrode with analyte samples on its surface, (b) at least one intermediate acceleration electrode, (c) a base electrode positioned in front of a field-free flight path of the mass spectrometer, and (d) an ion current detector at the end of the flight path to measure the flight time spectrum of the ions, whereby the mass spectrometer exhibits the following geometric conditions:

(1) the distance between said sample support electrode and the base electrode is larger than one eighth of the flight path length but smaller than half the flight path length, and (2) the distance between said sample support electrode and first intermediate acceleration electrode is smaller than half the length between said first intermediate acceleration electrode and said base electrode.

2. Mass spectrometer according to claim 1, with only one intermediate electrode, forming a first ion accelerating region of length $d_1$ between the sample support electrode and an intermediate electrode, and a second accelerating region of length $d_2$ between the intermediate electrode and the base electrode and with a subsequent field-free flight path of the length $d_3$, wherein $d_3/2>(d_1+d_2)>d_3/8$ and $d_1<d_2/2$.

3. Mass spectrometer according to claim 2, wherein $d_2/60<d_1<d_2/10$.

4. Mass spectrometer according to claim 3, wherein the relative distances $d_1$:$d_2$:$d_3$ substantially satisfy the ratio 5:244:550.

5. Mass spectrometer according to claim 3, wherein a third order focusing for the highest ion mass of an mass range of interest is set by design of length $d_1$.

6. Mass spectrometer according to claim 5, wherein said distance $d_1$ between the sample support electrode and intermediate electrode is mechanically adjustable.

7. Mass spectrometer according to claim 1, wherein the time lag $\tau$ and the first accelerating voltage $U_1$ between the sample support electrode and said intermediate electrode are adjustable for shifting the focus range.

8. Mass spectrometer according to claim 1, wherein a first accelerating voltage $U_1$ is adjusted optimally for the highest mass of interest and kept constant, and only a time lag $\tau$ is adjustable for shifting the focus range.

9. Mass spectrometer according to claim 1, further comprising an ion-optical lens integrated into a path of the ions.

* * * * *